US007377101B2

(12) United States Patent
Mital et al.

(10) Patent No.: US 7,377,101 B2
(45) Date of Patent: May 27, 2008

(54) PLASMA FUEL CONVERTER NOX ADSORBER SYSTEM FOR EXHAUST AFTERTREATMENT

(75) Inventors: Rahul Mital, Columbus, IN (US); Bradlee J. Stroia, Columbus, IN (US); Robert C. Yu, Columbus, IN (US)

(73) Assignee: Fleetguard, Inc., Nashville, IN (US)

( * ) Notice: Subject to any disclaimer, the term of this patent is extended or adjusted under 35 U.S.C. 154(b) by 315 days.

(21) Appl. No.: 10/778,275

(22) Filed: Feb. 13, 2004

(65) Prior Publication Data

US 2005/0178107 A1 Aug. 18, 2005

(51) Int. Cl.
*F01N 3/00* (2006.01)

(52) U.S. Cl. ..... 60/275; 60/274; 60/276; 60/286; 60/295; 60/297; 60/324

(58) Field of Classification Search ..... 60/274, 60/275, 276, 285, 286, 295, 297, 303, 324; 123/1 A, 3, DIG. 12
See application file for complete search history.

(56) References Cited

U.S. PATENT DOCUMENTS

| | | | |
|---|---|---|---|
| 3,983,021 | A | 9/1976 | Henis |
| 4,573,435 | A | 3/1986 | Shelton |
| 4,692,318 | A | 9/1987 | Tolpin et al. |
| 4,766,855 | A | 8/1988 | Tozzi |
| 5,425,332 | A | 6/1995 | Rabinovich et al. |
| 5,437,250 | A | 8/1995 | Rabinovich et al. |
| 5,746,984 | A | 5/1998 | Hoard |
| 5,782,085 | A | 7/1998 | Steinwandel et al. |
| 5,855,855 | A | 1/1999 | Williamson et al. |
| 5,882,980 | A | 3/1999 | Bae |
| 5,887,554 | A | 3/1999 | Cohn et al. |

(Continued)

FOREIGN PATENT DOCUMENTS

| | | |
|---|---|---|
| JP | 2001-182525 | 7/2001 |
| WO | WO 98/09699 | 3/1998 |

OTHER PUBLICATIONS

"Control of Nitrogen Oxide Emissions: Selective Catalytic Reduction (SCR)," Clean Coal Technology, The U.S. Department of Energy and Southern Company Services, Inc., Topical Report No. 9. Jul. 1997, pp. 1-24.

*Primary Examiner*—Tu M. Nguyen
(74) *Attorney, Agent, or Firm*—Andrus, Sceales, Starke & Sawall, LLP; J. Bruce Schelkopf

(57) ABSTRACT

The invention provides a NOx adsorber aftertreatment system for internal combustion engines which utilizes a plasma fuel converter operatively coupled to at least one NOx adsorber to aid in the regeneration of the NOx adsorber. Fuel and engine exhaust is injected into a plasma fuel converter upstream of a NOx absorber producing reductant such as $H_2$, and CO, which are inlet into the NOx absorber. Reductants such as $H_2$ and CO acting along and together help to efficiently regenerate the NOx Adsorber which in turn releases exhausts products such as $CO_2$ and $N_2$. Using the reductants generated by the plasma fuel converter NOx adsorbers, catalytic soot filter, and the like can be regenerated at exhaust temperatures less than 250° C. The plasma fuel converter, NOx adsorber regenerating aftertreatment system of the present invention may be used with any suitable control system.

40 Claims, 7 Drawing Sheets

U.S. PATENT DOCUMENTS 6,003,305 A 12/1999 Martin et al.
6,038,854 A 3/2000 Penetrante et al.
6,047,543 A 4/2000 Caren et al.
6,058,698 A 5/2000 Coral et al.
6,119,451 A 9/2000 Vogtlin et al.
6,176,078 B1 1/2001 Balko et al.
6,185,930 B1 2/2001 Lepperhoff et al.
6,202,407 B1 3/2001 Brusasco et al.
6,264,899 B1 7/2001 Caren et al.
6,267,864 B1 7/2001 Yadav et al.
6,321,531 B1 11/2001 Caren et al.
6,330,794 B1 12/2001 Caren et al.
6,345,497 B1 2/2002 Penetrante
6,357,223 B1 3/2002 Caren et al.
6,363,716 B1 4/2002 Balko et al.
6,374,595 B1 4/2002 Penetrante et al.
6,397,582 B1 6/2002 Hanaoka et al.
6,422,002 B1 7/2002 Whealton et al.
6,436,363 B1 8/2002 Hwang et al.
6,464,945 B1 10/2002 Hemingway
6,475,655 B1 11/2002 Nakanishi et al.
6,521,204 B1 2/2003 Borup et al.
6,526,950 B2 3/2003 Ito et al.
6,532,733 B1 3/2003 Tamura et al.
6,536,546 B2 3/2003 Roeser et al.
6,546,717 B1 4/2003 Chandler et al.
6,548,197 B1 4/2003 Chandran et al.
6,557,340 B1 5/2003 Twigg et al.
6,560,958 B1 5/2003 Bromberg et al.
6,581,374 B2 6/2003 Patchett et al.
6,843,054 B2 * 1/2005 Taylor et al. ..... 60/275
6,964,156 B2 * 11/2005 Liu et al. ..... 60/274
6,976,353 B2 * 12/2005 Daniel et al. ..... 60/275
7,188,469 B2 * 3/2007 Bonadies et al. ..... 60/286
7,213,395 B2 * 5/2007 Hu et al. ..... 60/286
2005/0274104 A1 * 12/2005 Bromberg et al. ..... 60/275

* cited by examiner

PLASMA FUEL CONVERTER NOX ADSORBER SYSTEM FOR EXHAUST AFTERTREATMENT

TECHNICAL FIELD OF THE INVENTION

The present invention relates generally to internal combustion engines and, more particularly, to the use of plasma fuel converts to regenerate components of exhaust aftertreatment systems.

BACKGROUND OF THE INVENTION

As environmental concerns have led to increasingly strict regulation of engine emissions by governmental agencies, reduction of nitrogen-oxygen compounds (NOx) in exhaust emissions from internal combustion engines has become increasingly important. Current indications are that this trend will continue.

In the past, the emission levels of US diesel engines have been regulated according to the Environmental Protection Agency (EPA) using the Federal Test Procedure (FTP) cycle, with a subset of more restrictive emission standards for California via the California Air Resources Board (CARB).

Future emission from diesel engines will have to be further reduced in order to meet proposed and soon to be implemented EPA emission standards. For example, the Tier II emission standards, which are being considered for 2004, are 50% lower than the Tier I standards. Car and light truck emissions are measured over the FTP 75 test and expressed in gm/mi.

Regulatory agencies continue to propose and apply ever-stricter emission standards. For example, proposed Ultra-Low Emissions Vehicle (ULEV) emission levels for light-duty vehicles up to model year 2004 are 0.2 gm/mi NOx and 0.08 gm/mi particulate matter (PM). Beginning with the 2004 model year, all light-duty Low Emission Vehicles (LEVs) and ULEVs in California would have to meet a 0.05 gm/mi NOx standard to be phased in over a three-year period. In addition to the NOx standard, a full useful life PM standard of 0.01 gm/mi would also have to be met. The EPA has also proposed tighter regulations for off-road diesel engines requiring them to emit 90% less particulate matter and nitrogen oxides by 2014 than they do today.

Traditional methods of in-cylinder emission reduction techniques such as exhaust gas recirculation (EGR) and injection rate shaping, by themselves, will not be able to achieve the low emission levels required by these standards. Aftertreatment technologies will have to be used and will have to be further developed in order to meet the future low emission requirements set for diesel engines.

Some promising aftertreatment technologies to meet future NOx emission standards include lean NOx catalysts, NOx adsorbers, and Selective Catalytic Reduction (SCR) catalysts. Currently, used lean NOx catalyst technologies result in the reduction of engine NOx emissions in the range of 10 to 30 percent for engines operated under typical conditions. Although a promising technology, SCR catalyst systems require an additional reducing agent (aqueous urea). The need for this compound raises issues related to the relatively high freezing point of the compound and the need to develop and support a distribution system for this compound.

When NOx adsorbers are used to sequester NOx they must be periodically regenerated. One way of regenerating NOx adsorbers is by using pre-cats (catalysts, which partially oxidize hydrocarbon to produce reductants and heat).

Commonly used pre-cats produce exhaust gasses enriched in volatile hydrocarbons, $CO_2$, and water. These compounds are effective at regenerating commonly used NOx adsorbers when the adsorbers are regenerated at temperatures in the 500° C. range. The need for elevated temperatures make this class of reductants impractical for the regeneration of NOx adsorbers used with internal combustion engines that operate at relatively low temperatures, such as, light duty diesel engines. Light-duty diesel engines are commonly found in cars and light duty trucks, a rapidly growing segment of the diesel engine market.

Another promising approach is the use of a non-catalytic process for the removal of NOx and particulates from engine exhausts. Oxygen rich diesel engine exhaust containing NOx is fed into a plasma generator incorporating for example a gamma-aluminum component. Electrical current and additional hydrocarbon fuel supplied to the unit are used to produce volatile hydrocarbons that react with NOxs and carbon-based soot in engine exhaust to produce more environmentally benign products such as $N_2$ and $CO_2$. For a more comprehensive discussion of this technology the reader is directed toward U.S. Pat. No. 6,038,854 to Penetrante, et al. herein incorporated by reference in its entirety. The primary component of the non-catalytic NOx removal system is a plasma source requiring a continuous source of electrical current, therefore the use of this system may result in a significant fuel penalty.

Non-thermal plasma generators use electrical current and oxygen, and operating at temperatures in the range of 500° C. These devices reform hydrocarbons to produce reductants enriched in reactive oxygenated organic molecules. Ready source of hydrocarbon fuel includes, for example, diesel fuel. Reactive oxygenates produced by the process can react with NOx and carbon-based soot to produce environmentally benign species such as $N_2$, $CO_2$, and $H_2O$. For a more detailed discussion of this technology the reader is directed to U.S. Pat. No. 6,176,078 to Balko et al., and to "Thermal Cracking of Higher Paraffins" by H. H. Voge and G. M. Good, Journal of the American Chemical Society, Vol. 71, pages 593-597, February, (1949).

The oxygenated organic molecules produced by this system contain at least one carbon atom and generally no more than 3 carbons. The longer chain reductants may have difficulty permeating ultra-fine NOx adsorber matrices or heavily sooted particulate filters.

Internal combustion engine exhaust gas aftertreatment systems that use plasma fuel converters, which require a supply of fresh air, water, fuel, and electricity, have been used to produce reductants, which are used, in turn, to regenerate NOx adsorbers. See, for example, U.S. Pat. No. 6,560,958 to Bromberg. The systems proposed so far require a dedicated source of water and air to ensure the efficient operation of the plasma fuel generator. The need for a dedicated source of water limits the utility of these systems, especially when they are used with mobile internal combustion engines or with stationary engines operated in environments which lack ready access to a dedicated water supply.

These technologies, therefore, have limitations that may prevent their use in achieving the new emissions requirements as efficiently as possible. There is a need then for an engine aftertreatment system that provides a source of extremely reactive reductants that can effectively regenerate NOx adsorbents, including systems using an ultra-fine catalyst bed, that does not result in a significant fuel penalty and that can be readily operated in the absence of a dedicated supply of fresh air and water. The present invention is directed toward meeting this need.

SUMMARY OF THE INVENTION

One aspect the invention provides is a NOx adsorber aftertreatment system for internal combustion engines which utilizes a plasma fuel converter (PFC) upstream of a NOx adsorber/reducer to regenerate the NOx adsorber. A slipstream of engine exhaust is sent through a valve operatively linked to the PFC and fuel is injected directly into the PFC by an injector with an inlet operatively linked to a dedicated fuel pump. The dedicated fuel pump has an inlet operatively linked to a fuel tank and an outlet operatively linked to the injector. The amount of fuel, exhaust gas, and electrical current delivered to the PFC may be adjusted to produce reductants such as CO and $H_2$, as required, reduce NOx to $N_2$ and to regenerate various aftertreatment components. Components such as NOx adsorbers, Selective Catalytic Reduction (SCRs) catalysts, catalytic soot filters (CSFs), and the like. The operating temperature of the PFC is on the order of 800° C. although the exhaust gas from the PFC may be considerably cooler. Reductants produced by the PFC may be cooled by, for example, the use of a heat exchanger operatively linked to the outlet of the PFC.

In one embodiment, the system operates in a continuous reforming and continuous regeneration mode. Internal combustion engine exhaust gas, fuel, and electrical current are supplied to the PFC. Reductants generated by the PFC are fed continuously by a reductant pump into the components of the aftertreatment system to be regenerated, such as NOx adsorbers and CSFs.

In another embodiment, the system operates in an intermittent reforming and intermittent regenerating mode. The flow of exhaust gas, fuel, and electrical current to the PFC may be turned off or reduced during periods in which there is no need to regenerate the NOx adsorber(s).

In one preferred embodiment, at least a sacrificial amount of fuel is delivered to the PFC at all times to maintain it at operating temperature. When reductants are required to regenerate the NOx adsorbers, SCR catalysts, and/or CSFs, to keep them operating within an acceptable range, additional fuel is injected into the PFC.

In another embodiment, the system operates in continuous reforming and intermittent regenerating mode. Whenever the engine is running, exhaust gas, hydrocarbon fuel, and electrical current is supplied to the PFC which continuously produces a stream of reductants. Reductants pass through a check valve operatively positioned between the outlet stream of the PCF and the inlet of a storage vessel designed to store and dispense reductants.

The storage pressure vessel is designed to withstand internal pressures in the range of 100 psi, and operating pressures of 40 to 60 psi. The storage vessel may be of any size, preferably in the range of 0.5-2 L, and is configured to store enough reductant to regenerate the system 1-5 times. A reductant pump has a reductant pump inlet operatively linked to the storage vessel outlet and a reductant pump outlet operatively linked to a valve that controls the flow of reductant to other components of the system.

In one embodiment, the outlet of the reductant pump is operatively linked to a valve that controls the delivery of reductant to downstream exhaust aftertreatment components such as NOx adsorbers and CFSs.

The PFC can be used to supply reductants to an aftertreatment system with any arrangement of NOx adsorbers, Selective Catalytic Reduction (SCR) catalysts, catalytic soot filters, sulfur traps, precats, or the like.

One aspect of the invention provides a method for treating engine exhaust comprising: providing an exhaust aftertreatment system comprising: an exhaust valve system having an exhaust valve inlet operatively coupled to the engine exhaust, a first valve output, and a second valve output.

A PFC is provided having a PFC inlet operatively coupled to the first exhaust valve outlet and a PFC output. At least one NOx adsorber, SCR catalyst, and/or a CSF having an inlet operatively coupled to said PFC outlet, and a NOx adsorber, SCR catalyst, and/or CSF output. A fuel tank is operatively coupled to a fuel pump having a fuel pump intake operatively coupled to said fuel tank and a fuel pump outlet. A controller is provided operatively linked to the valve system, injector, fuel pump, and optional NOx, $O_2$, $CO_2$, hydrocarbon, $H_2$, and/or heat sensors.

The controller may adjust valves in the aftertreatment system to alter the flow of exhaust to the PFC operatively coupled to the components of the exhaust aftertreatment system undergoing regeneration. The controller activates the fuel pump providing fuel to the fuel injector thereby regulating fuel flow to the PFC. It also regulates the amount of current delivered to the PFC. As necessary, the controller may increase the production and/or delivery of reductants to the component(s) of the exhaust aftertreatment system requiring regeneration.

In one embodiment, the controller monitors the inlet from the lambda sensor and regulates the fuel pump and injector supplying fuel to the PFC and adjusts the exhaust valve system to either increase or decrease the flow of exhaust gas to the operatively linked NOx adsorbers.

In another aspect of the invention, the aftertreatment system includes a storage vessel for storing and dispensing reductants generated by the PFC.

In one embodiment of the invention, the system operates in a continuous reforming and continuous regenerating mode.

In another embodiment of the invention, the system operates in intermittent reforming and intermittent regenerating mode.

In still another embodiment of the invention, the system operates in continuous reforming and intermittent regenerating mode.

In one aspect of the invention, the valve system used in the exhaust aftertreatment system may be either a proportional 3-way valve or a pair of 2-way valves. The valves may be of a kind that open and close by discrete amounts or valves that are continuously variable in their output.

In one aspect of the invention, the aftertreatment systems includes a temperature and lambda sensor and/or a NOx sensor operatively coupled to the valve system output, and/or NOx adsorber output(s) that relays information to the system controller.

In one aspect of the invention, the aftertreatment system is operated under a closed control system. Under closed control operation data from sensors within the system are processed by the controller. Based on feedback from sensors in the aftertreatment system and programmed standards for NOx adsorber performance, the controller determines when to activate and deactivate the components of the system designed to regenerate NOx adsorbers in the system.

In another aspect of the invention, the aftertreatment system is operated in an open control system. In an open control system the controller activates and deactivates components of the aftertreatment regeneration system based upon stored engine-run parameters such as time, fuel usage, engine speed, and the like. Feedback from sensors within the system is not used to make adjustment to the regeneration system within a given cycle. Therefore, information from optional sensors is not necessary for the functioning of the system though such information can be used, for example, to warn of problems with components within the system.

DETAIL DESCRIPTION OF THE PREFERRED EMBODIMENTS

Figure 1:
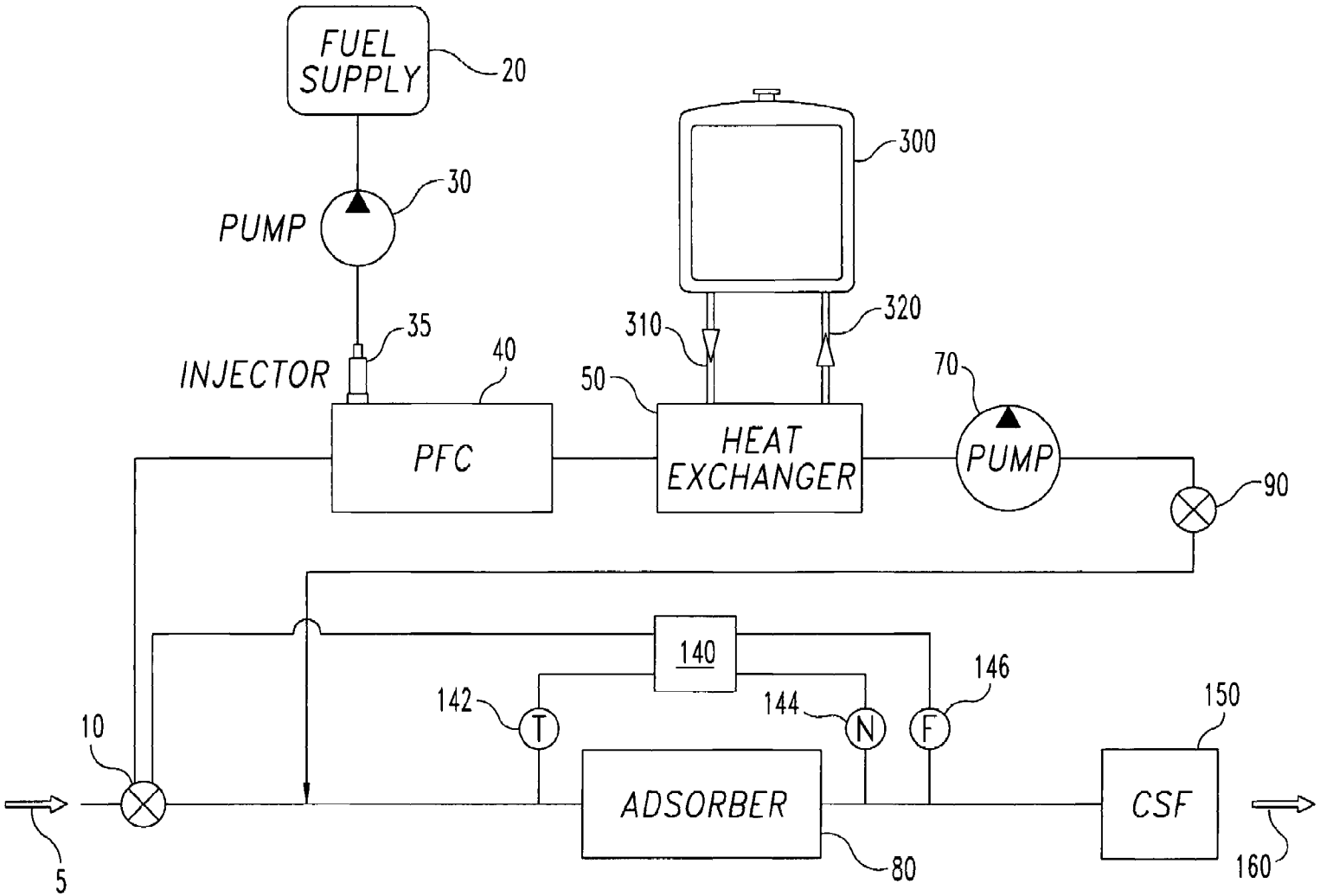
FIG. 1 is a schematic block diagram of a preferred embodiment of the present invention.

For the purposes of promoting an understanding of the principles of the invention, reference will now be made to the embodiment illustrated in the drawings and specific language will be used to describe the same. It will, nevertheless, be understood that no limitation of the scope of the invention is thereby intended, and alterations and modifications in the illustrated device, and further applications of the principles of the invention as illustrated therein are herein contemplated as would normally occur to one skilled in the art to which the invention relates.

NOx adsorber catalysts have the potential for great NOx emission reduction (60-90%) and the NOx adsorber is one of the most promising NOx reduction technologies. During lean-burn operation of the engine, the NOx trap adsorbs nitrogen oxide in the form of stable nitrates. Commonly used NOx adsorbers are comprised of, for example, precious metals such as platinum, rhodium, and at least one alkali metal, as for example potassium, sodium, lithium, and cesium; alkali-earth metals such as barium and calcium; and rare earth metals such as lanthanum and yttrium. NOx adsorbers operate by sequestering nitrogen oxides under lean conditions and then releasing $N_2$ under rich conditions.

NOx adsorbers that may be used to practice the invention include, for example, a precious metal catalyst such as platinum, and a NOx adsorbent such as barium oxide and are thought to operate as follows. Under lean conditions (when the concentration of $O_2$ in the exhaust gas is relatively high) oxygen is deposited on the surface of platinum in the form of $O_2^-$ or $O^{2-}$ and reacts with NO in the exhaust by the reaction $2NO+O_2 \rightarrow 2NO_2$. $NO_2$ is further oxidized on the surface of the platinum to form $NO_3$ (nitric acid ions) and nitric acid ions bind to the barium oxide component of the adsorber to form, for example, $BaNO_3$.

Selective Catalytic Reduction (SCR) catalysts include, for example, vanadium or tungsten oxides on a ceramic carrier. One commonly used SCR process introduces $NH_3$ into the exhaust stream comprising NOx. $NH_3$, usually in the form of urea, and NOx react on the surface of the catalyst to produce $N_2$ and $H_20$. SCR, when provided with the appropriate catalyst, may also catalyze the reduction of NOx to $N_2$ and water using reductants such as $H_2$.

Sulfur and sulfur containing molecules in the exhaust also react with precious metal catalysts such as platinum and form complexes with adsorbents such as barium oxide. Sulfur complexes formed between metal catalysts and NOx adsorbents are generally more thermodynamically stable than similar complexes formed with NOx. Sulfurous compounds in the exhaust, then, may poison precious metal catalysts. Since sulfur complexes are often times more stable than nitrogen complexes, SOxs may not be as readily released from NOx adsorbents as are NOxs under commonly used adsorbent regeneration schemes. In order to lessen the deleterious effects of sulfur on emission control components, many systems use fuel low in sulfur content and/or sulfur traps to further reduce the level of sulfurous compound in the engine emissions.

Under rich (stoichiometric) conditions, where the concentration of oxygen in the engine exhaust is relatively low the reaction to form nitric acid ions is reversed ($NO_3 \rightarrow NO_2$) and NOx in the form of $NO_2$ is released from the adsorbent. In the presence of a precious metal catalyst such as platinum, $NO_2$ may react with reductants such as $H_2$ and CO to form $N_2$. Similarly, albeit often under harsher conditions, SOxs may also react with reductants under rich conditions to form elemental sulfur.

Exhaust aftertreatment systems especially those used in connection with diesel engines often employ a carbon soot filter to trap carbon-based particulates and reduce the level of these compounds released into the atmosphere. Carbon soot filters that include a catalyst for the regeneration of the filter via the oxidation of carbon-soot particles entrapped by the device are referred to as catalytic soot filters (CSFs). In addition to providing a means for regenerating the filter by oxidizing the entrapped carbon-based soot these devices also help to oxidize unburned volatile hydrocarbons in the exhaust preventing their release into the atmosphere. Regeneration of CSFs is commonly accomplished by injecting rich fuel mixtures into the CSF to facilitate the catalytic oxidation of the entrapped particles.

One aspect of the invention is an exhaust aftertreatment system comprising a dedicated fuel supply, a plasma fuel converter (PFC), a NOx adsorber for sequestering NOx produced by internal combustion engines, and if necessary or desirous other components for the reduction of NOx, SOx, soot, and volatile hydrocarbons from internal combustion engine exhaust.

Referring now, for example, to FIG. 1. Plasma Fuel Converter (PFC) 40 uses electrical current and engine exhaust 5 to reform hydrocarbon fuel such as diesel fuel producing between 1-30% $H_2$ and 1-30% CO based on either $H_2$ or CO expressed as a percentage of total reductant formed from the fuel. The actual amount of $H_2$ or CO produced as a percentage of fuel converted is determined, at least in part by, the composition of and amount of fuel and exhaust gas present in the PFC. Other factors influencing the amount of reductants produced include the amount of electrical current applied to the PFC, and the temperature inside the PFC. For example, the amount of reductant produced within the first 5 to 10 seconds after the PFC is energized from a cold start may be substantially less than the amount of reductant produced once the PFC has reached its optimal operating temperature.

Referring still to FIG. 1, there is illustrated a schematic block diagram of a preferred embodiment of the present invention. This embodiment is particularly well configured for either continuously reforming hydrocarbon fuels and continuously regenerating NOx adsorbers 80 and CSF 150 and the like, or intermittently reforming hydrocarbons and intermittently regenerating NOx adsorber 80, CSF 150, and the like.

The exhaust gas aftertreatment system is designed to remove NOxs from exhaust 5 produced by an internal combustion engine (not shown) and to efficiently regenerate NOx adsorber 80 used in the system. A 3-way exhaust valve 10 is provided having an inlet operatively linked to the source of engine exhaust 5, an exhaust valve 10 first outlet, and an exhaust valve 10 second outlet. A NOx adsorber 80 is provided having an inlet operatively linked to the second outlet of 3-way exhaust valve 10 and a NOx adsorber 80 outlet. Optionally a CSF 150 may be provided, having an inlet operatively linked to the NOx 80 outlet, and a CSF 150 outlet. A tailpipe 160 is provided having an inlet operatively linked directly to the outlet of NOx 80, or optionally to the outlet of optional CSF 150, and a tailpipe 160 outlet. The outlet of tailpipe 160 is operatively vented to the atmosphere.

The aftertreatment system illustrated in FIG. 1 further includes (PFC) 40. PFC 40 has an inlet operatively linked to the first outlet of 3-way exhaust valve 10, and a PFC 40 outlet, a PFC 40 fuel inlet, and means for connecting PFC 40 to a source of electrical power (not shown). When sufficient electrical current is applied to PFC 40, at least a portion of the hydrocarbon present in device 40 is reformed into reductants such as $H_2$, CO, volatile hydrocarbons, and the like.

A fuel injector 35 is provided having an outlet operatively linked to PFC 40 fuel inlet, and a fuel injector inlet. A fuel pump 30 is provided having a fuel pump outlet operatively linked to the inlet of fuel injector 35 and a fuel pump 30 inlet. A fuel supply tank 20 is provided having a fuel supply tank 20 outlet operatively linked to the inlet of fuel pump 30.

The system may optionally include heat exchanger 50 having an inlet operatively linked to the outlet of PFC 40, and a heat exchanger 50 outlet.

In one embodiment heat exchanger 50 has a heat exchanger 50 coolant inlet and a heat exchanger 50 coolant outlet. In this embodiment the system is provided with radiator 300 having a radiator 300 inlet and a radiator 300 outlet. Radiator 300 outlet is operatively linked to the inlet of coolant pipe 310. Coolant pipe 310 has a coolant pipe 310 outlet operatively linked to heat exchanger 50 coolant inlet. The system is provided with coolant pipe 320 having a coolant pipe 320 inlet operatively linked to heat exchanger 50 coolant outlet, and a coolant outlet pipe 320 inlet. Coolant pipe 320 outlet is operatively linked to radiator 300 inlet.

In still another embodiment radiator 300 is a dedicated gas to air heat exchanger.

A reductant pump 70 is provided having a reductant pump 70 inlet operatively linked to either the outlet of PFC 40, or to the outlet of optional heat exchanger 50, and a reductant pump 70 outlet. Reductant pump 70 may be sized to operate in the 0-100 pounds per square inch (p.s.i.) range and to deliver between 0-200 ml/min of exhaust gas enriched in reductant. A 2-way reductant control valve 90 is provided having an inlet operatively connected to the outlet of reductant pump 70, and a reductant valve 90 outlet. The outlet of reductant valve 90 is operatively linked to the inlet of NOx adsorber 80. While the invention is illustrated with three sensors, 142, 144, 146, any number of sensors can be included in the aftertreatment system and used to practice the invention.

In one embodiment of the invention, exhaust gas entering the inlet of NOx adsorber 80 passes by sensor 142 sensor input. Sensor 142 may be selected for, or configured to, provide data on exhaust parameters such as NOx levels, lambda, hydrocarbon levels, CO levels, NOx levels, oxygen levels, temperature, and the like, or any combination thereof. Optionally, exhaust gas output by NOx adsorber 80 passes by optional NOx sensor 144, and sensor 146. Sensor 146 may be configured to detect and transmit data on exhaust components and parameters such as hydrocarbon levels, oxygen levels, temperature, lambda, and the like. All sensors and all activatable components can be operatively linked to controller 140.

In one preferred embodiment of the invention, NOx adsorber 80 is regenerated in continuous mode. Reductant pump 70 continuously delivers reductants to NOx catalyst 80.

In one preferred embodiment of the invention, the exhaust gas aftertreatment system is designed to operate particularly well in the intermittent reforming intermittent regenerating mode. When the invention is practiced in the intermittent reforming intermittent regenerating mode, quantities of reductants sufficient to regenerate NOx adsorber 80 are produced by PFC 40 only when it is deemed necessary to regenerate adsorber 80. When it is not deemed necessary to regenerate NOx adsorber 80, very little or no exhaust gas 5 is shunted by exhaust valve 10 to PFC 40, and no fuel is injected into PFC 40. Additionally, when it is deemed unnecessary to regenerate either NOx adsorber 80 or optional CSF 150 the amount of electrical current delivered to PFC 40 may be reduced to, for example, 0 amperes.

Operating in the intermittent reforming intermittent regenerating mode, the levels of electrical current, exhaust gas, and fuel delivered to PFC 40 may be increased to produce reductants such as $H_2$, CO, volatile hydrocarbons, and the like as required to regenerate NOx 80, or CSF 150.

In the embodiment illustrated in FIG. 1, reductant pump 70 pumps reductants through valve 90 into the NOx adsorber 80.

In the intermittent reforming intermittent regenerating embodiment of the invention there will likely be a lag between the time exhaust, current, and hydrocarbon fuel are delivered to PFC 40 and when PFC 40 actually produces useful levels of reductant. This lag is due in part to the need for PFC 40 to reach optimum operating temperature, which may be in the range of 800° C., before it begins efficiently reforming fuel. The lag-time, from a cold start of PFC 40 to the efficient reformation of fuel, is estimated to be on the order of 5-10 seconds, although longer lag times can be expected under cold weather operating conditions.

In still another embodiment of the invention, once the system is started, a sacrificial amount of hydrocarbon fuel and electrical current are supplied to PFC 40 at all times to help maintain PFC 40 at or near is peak operating temperature. As required, the amount of fuel, electrical current, and exhaust gas delivered to PFC 40 are increased to produce reductants for the regeneration of NOx adsorber 80. Similarly, the production of reductants by PFC 40 can be increased as required to meet the need for more reductants and/or heat. One advantage of this embodiment is that once the system is started there is virtually no lag-time between the time reductants are required and when they are produced at useful levels.

As illustrated in FIG. 1 the exhaust aftertreatment system comprises an engine exhaust valve system to distribute engine exhaust to various components of the aftertreatment. In one preferred embodiment, the system comprises a 3-way valve 10 having a 3-way valve inlet operatively linked the internal combustion engine exhaust 5, a 3-way exhaust valve 10 first outlet, and a 3-way exhaust valve second outlet.

Figure 2:
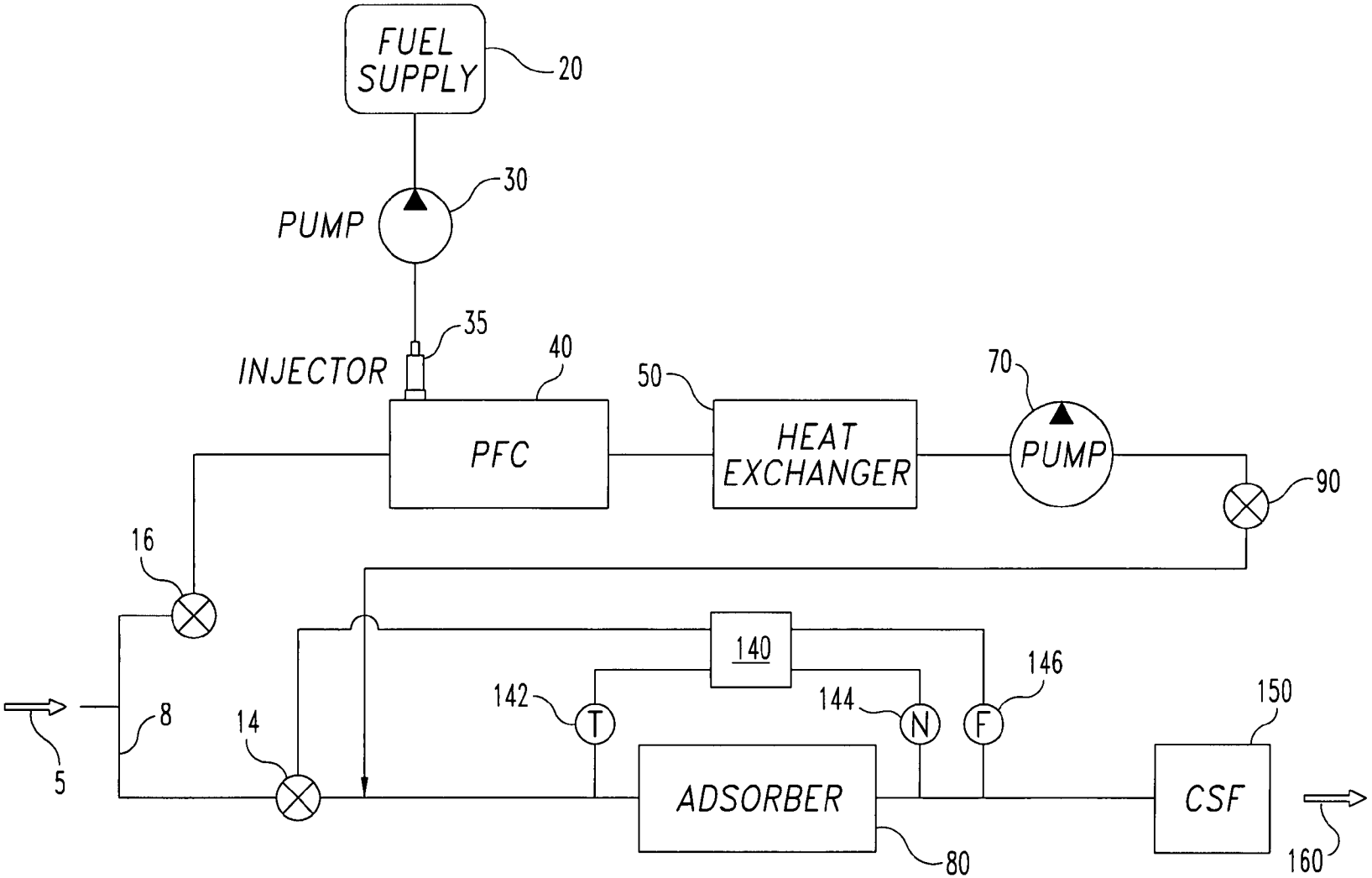
FIG. 2 is a schematic block diagram of a preferred embodiment of the present invention.

Referring now to FIG. 2, in another embodiment, the exhaust valve system comprises an exhaust gas crossover pipe 8 having an exhaust pipe crossover pipe 8 inlet, an exhaust pipe crossover pipe 8 first outlet, and an exhaust pipe 8 second outlet. A first 2-way valve 16 is provided having a first 2-way valve 16 inlet operatively linked to the exhaust crossover pipe 8 first outlet, and a first 2-way valve 16 outlet operatively linked to the inlet of PFC 40. A second 2-way valve 14 is provided having a second 2-way valve 14 inlet operatively linked to the exhaust crossover pipe 8 second outlet and a second 2-way valve 14 outlet operatively linked to the inlet of NOx adsorber 80.

Whether to practice the invention with an exhaust valve system comprising two, 2-way valves (as illustrated in FIG. 2) or with an exhaust valve system comprising a single 3-way valve (as illustrated in FIG. 1) depends upon the relative cost, quality, and availability of 2-way versus 3-way valves.

Figure 3:
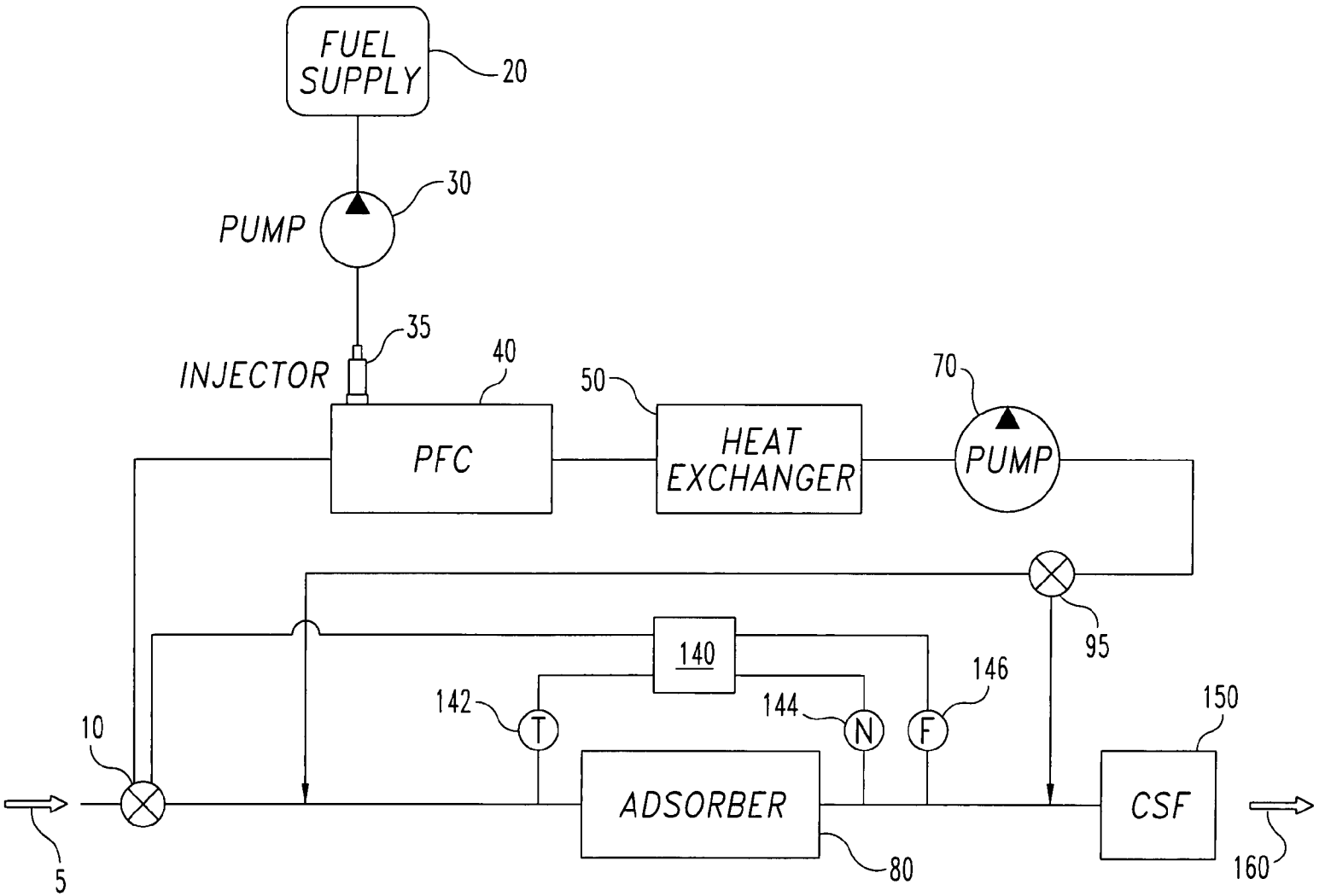
FIG. 3 is a schematic block diagram of another preferred embodiment of the present invention.

Referring now to FIG. 3, another embodiment the after-treatment system includes 3-way reductant valve 95 having an inlet operatively linked to the outlet of reductant pump 70, and a 3-way reductant valve 95 first outlet, and a 3-way reductant valve 95 second outlet. The first outlet of 3-way reductant valve 95 is operatively linked to the inlet of NOx adsorber 80. The second outlet of 3-way reductant valve 95 is operatively linked to the inlet of CSF 150. In this embodiment CSF 150 can be regenerated without having to pass reductant enriched exhaust through NOx adsorber 80. This embodiment may also include optional temperature, NOx, $CO_2$, lambda, and/or hydrocarbon sensors 142, 144, 146. All sensors and all activatable components can be operatively linked to controller 140.

Figure 4:
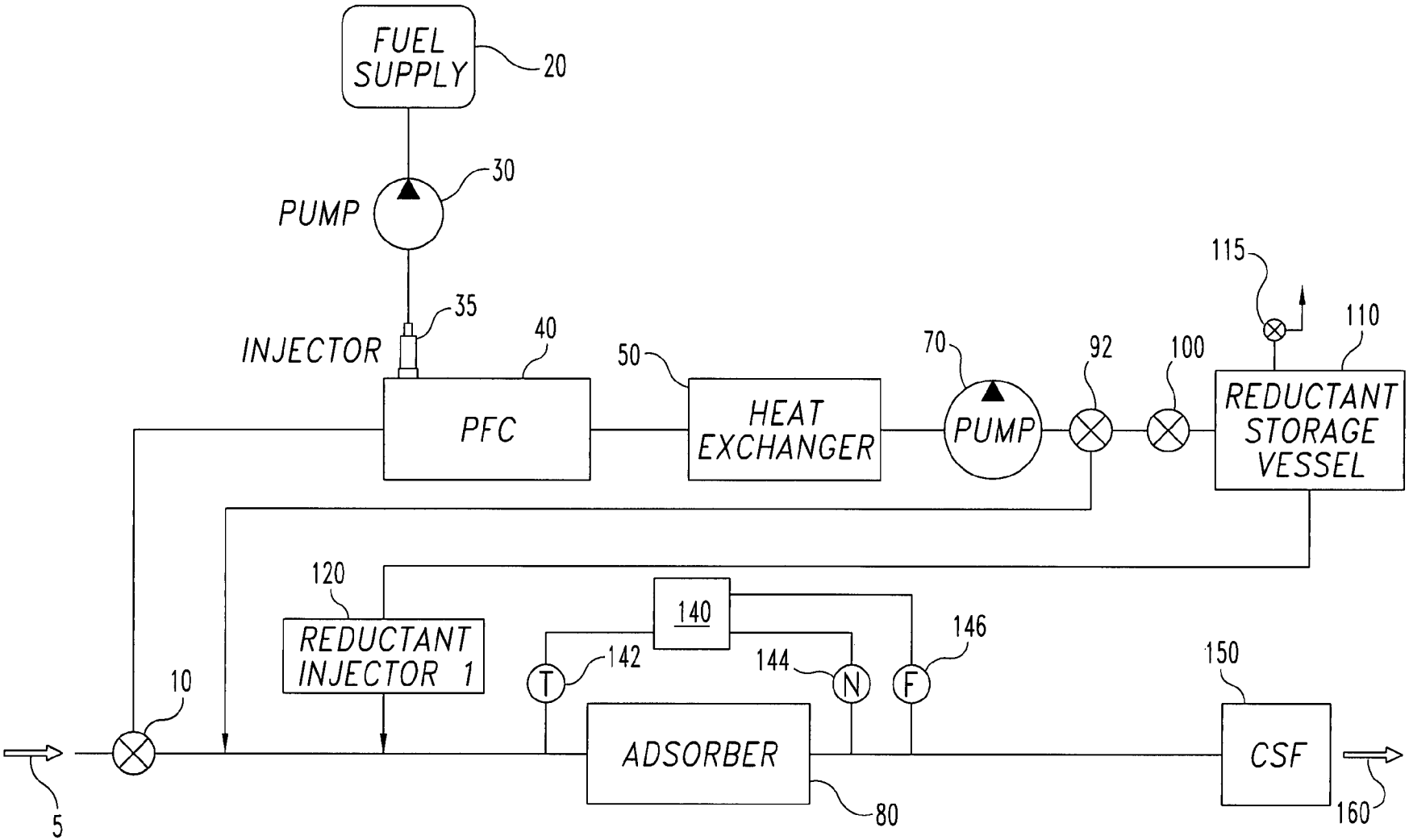
FIG. 4 is a schematic block diagram of still another preferred embodiment of the present invention.

Referring now to FIG. 4, an embodiment of the invention particularly well suited for operation in the continuous reforming intermittent regeneration mode is shown. Three-way exhaust valve 10 is provided having an inlet operatively linked to a source of internal combustion engine exhaust 5, a 3-way exhaust valve 10 first outlet and a 3-way exhaust valve 10-second outlet. A NOx adsorber 80 is provided having an inlet operatively linked to the first outlet of exhaust valve 10, and a NOx adsorber 80 outlet. An optional sensor 142 may be provided in the inlet to NOx adsorber 80 or the first outlet of 3-way exhaust valve 10.

The system includes PFC 40 having an inlet operatively linked to the second outlet of 3-way exhaust valve 10, and a PFC 40 outlet. A fuel injector 35 is provided having an outlet operatively linked to PFC 40, and fuel injector 35 input. A dedicated fuel pump 30 is provided having an outlet operatively linked to the inlet of fuel injector 35 and fuel pump 30 inlet. A fuel tank 20 is provided having an outlet operatively linked to the inlet of fuel pump 30. Fuel pump 30 and fuel injector 35 may be regulated by controller 140 and deliver fuel to PFC 40 continuously or only as required to regenerate components such as NOx adsorber 80 and CSF 150.

PFC 40, in a process that includes the use of electrical current, reforms hydrocarbon as, for example, diesel fuel to produce reductants such as $H_2$ and CO. Optional heat exchanger 50 has an inlet operatively linked to the outlet of PFC 40 and a heat exchanger 50 outlet. Reductant pump 70 is provided having an inlet operatively linked to the outlet of optional heat exchanger 50 or directly to the outlet of PFC 40, and a reductant pump 70 outlet.

The aftertreatment system further includes 3-way reductant valve 92 having an inlet operatively linked to the outlet of reductant pump 70, a 3-way reductant valve 92 first outlet and a 3-way reductant valve 92 second outlet. Check valve 100 is provided having an inlet operatively linked to the second outlet of 3-way reductant valve 92 and a check valve 100 outlet.

A reductant storage vessel 110 is provided having an inlet operatively linked to the outlet of check valve 100, a storage vessel 110 first outlet and an optional storage vessel 110 second outlet. Storage vessel 110 may be of any size although a size sufficient to store enough reductant to regenerate the system at between 1-5 times is preferred, this volume is estimated to be in the range of 0.5 to 2.0 L although both larger and smaller vessels are within the scope of the invention. Storage vessel 110 may be constructed of any material able to withstand internal pressures in the range of about 100-psi although typical operating pressures are expected to be in the range of 40 to 60 p.s.i. Storage vessel 110 is also constructed of materials, or at least lined with materials, that are able to withstand the corrosive effects of hot reductants such as $H_2$ and CO as well as corrosive compounds commonly found in internal combustion engine exhaust such as organic acids, sulfur containing compounds, and the like.

Pressure release valve 115 is provided having an inlet operatively linked to the optional second outlet of vessel 110 and a pressure release valve 115 outlet. The outlet of pressure release valve 115 is vented to the atmosphere. Pressure release valves are also referred to as over-pressure valves, safety valves, pressure relief valves, and the like. Pressure release valve 115 can be configured to release the contents of vessel 110 at any pressure thought to be dangerous or deleterious to the integrity of the system. Vessel pressure relief valve 115 may be set to release the content of vessel 110 at any pressure ranging from, for example, 0 to >200 p.s.i.

First reductant injector 120 has an inlet operatively linked to the first outlet of reductant storage vessel 110 and a first reductant injector 120 outlet. NOx adsorber 80 has an inlet operatively linked to the outlet of first reductant injector 120 and a NOx adsorber 80 outlet.

The second outlet of 3-way reductant valve 92 is operatively linked to the inlet of NOx adsorber 80. In one embodiment, the first outlet of optional 3-way reductant valve 92 is open to the inlet of NOx adsorber 80 when the engine (not shown) is started. This embodiment of the invention permits reductants produced by PFC 40 to enter the inlet of NOx adsorber 80 before reductant vessel 110 is filled.

Bypassing reductant storage vessel 110 shortens the lag time between regenerating absorber 80 and optional CSF 150 and is particularly useful when vessel 110 is empty or nearly empty and components such as 80, 150 require immediate regeneration. Once components 80, 150 are regenerated, valve 92 may switch to divert more of, or all of the output of PFC 40 into the inlet of reductant check valve 100. The outlet of check valve 100 is operatively linked to the inlet of storage vessel 110. Once storage vessel 110 is full or partially full of reductants, reductants stored in vessel 110 can be input into the operatively linked inlet of first injector 120. First injector 120 has an outlet operatively linked to the inlet of adsorber 80, and reductants stored in vessel 110 can be delivered to the inlet of adsorber 80 via the outlet of reductant injector 120.

In one embodiment, tailpipe 160 is provided having a tailpipe 160 inlet operatively linked to the outlet of NOx adsorber 80, and a tailpipe 160 outlet. The outlet of tailpipe 160 is operatively vented to the atmosphere.

In another embodiment, CSF 150 has an inlet operatively linked to the outlet of NOx adsorber 80 and a CSF 150 outlet. The outlet of CSF 150 is operatively linked to the inlet of tailpipe 160. The outlet of tailpipe 160 is operatively vented to the atmosphere.

In still another embodiment, the outlet from NOx adsorber 80 is operatively linked to optional NOx sensor 144 (N) and/or optional fuel, reductant, hydrocarbon, lambda and/or temperature sensor 146. Data collected by sensors 142, 144, 146 may be transmitted to controller 140.

In one embodiment of the invention, components such as 10, 40, 70, 92, 100, 120, and the like, are regulated by controller 140. When the system is operating in the closed loop control mode data from, for example, optional sensors 142, 144, 146 are processed by controller 140 and used to determine how regulated components including, for example, 10, 40, 70, 92, 100, 120 are adjusted to ensure that NOx adsorber 80 and CSF 150, are operating within acceptable performance ranges.

When the aftertreatment system is operated in the closed loop control mode, feedback from data sources such as sensors 142, 144, 146 can be used by controller 140 to make adjustments to the run parameters of PFC 40. Controller 140 can adjust PFC parameters such as the portion of exhaust gas delivered by valve 10, the amount of fuel injected by injector 35, and the level of electrical current delivered to PFC 40. Controller 140 can also be used to actuate valve 92, regulate reductant pump 70, and actuate reductant injector 120 to ensure that NOx adsorber 80 and CSF 150 are regenerated as necessary.

Figure 5:
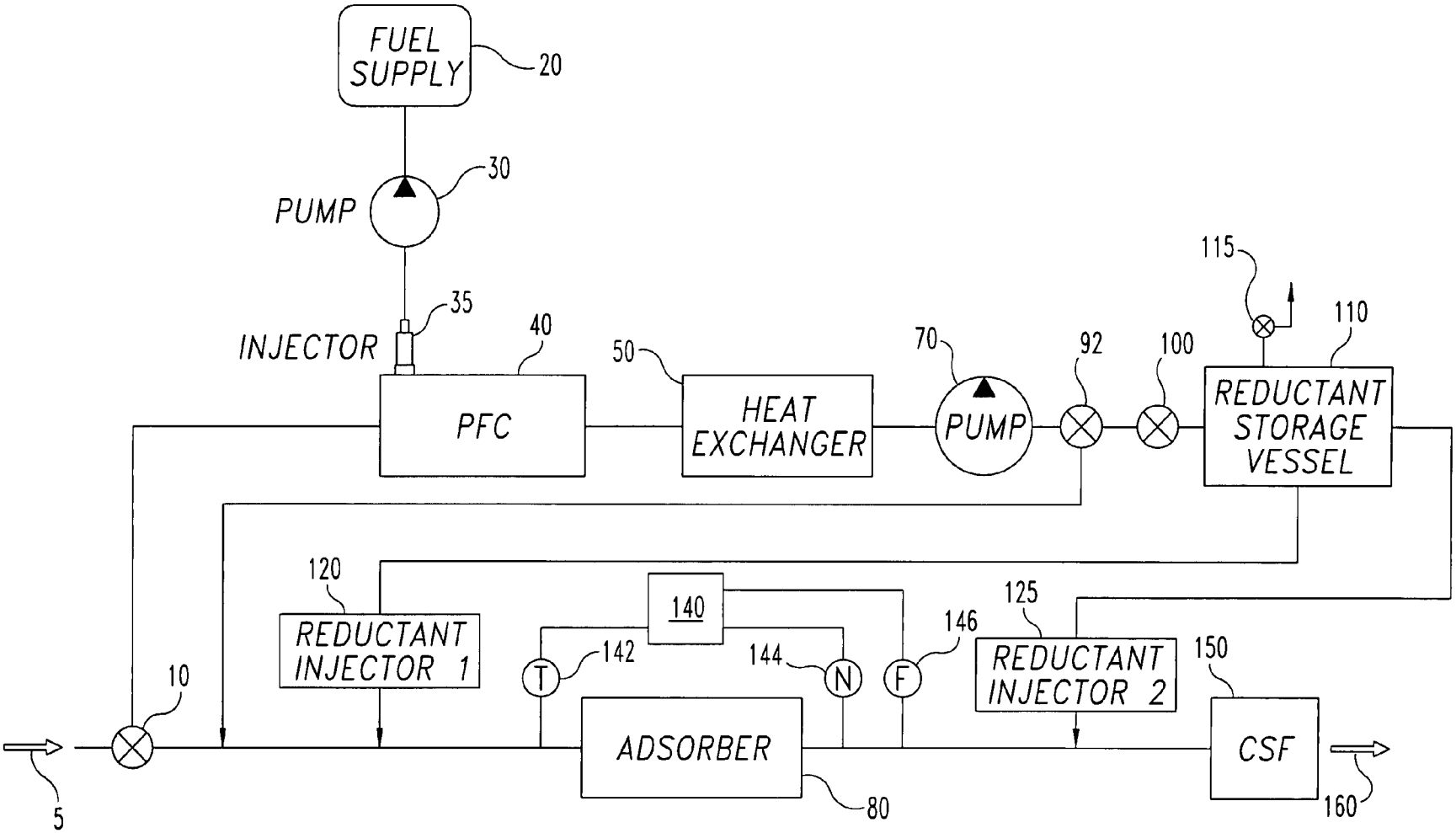
FIG. 5 is a schematic block diagram of yet another preferred embodiment of the present invention.

Referring now to FIG. 5, in one embodiment of the invention the exhaust aftertreatment system further includes a second reductant injector 125. In this embodiment reductant storage vessel 110 is provided with a third storage vessel 110 outlet. Second reductant injector 125 has an inlet operatively linked to the third outlet of reductant storage vessel 110, and a second reductant injector 125 outlet. CSF 150 has an inlet operatively linked to the outlet of reductant injector 125 and the outlet of NOx adsorber 80, and a CSF 150 outlet. Tailpipe 160 has an inlet operatively linked to the outlet of CSF 150, and a tailpipe 160 outlet. The outlet of tailpipe 160 is operatively vented to the atmosphere.

Under conditions wherein it may be necessary or advantageous to first regenerate CSF 150 without necessarily having to regenerate NOx adsorber 80, first reductant injector 120 may be deactivated and second reductant injector 125 may be activated. Under conditions wherein it may be necessary of advantageous to simultaneously regenerate both NOx adsorber 80 and CSF 150 both reductant injectors 120, 125 may be activated. Under conditions wherein it may be necessary or advantageous to regenerate NOx before regenerating CSF 150, first injector 120 may be activated while second reductant injector 125 is deactivated.

Figure 6:
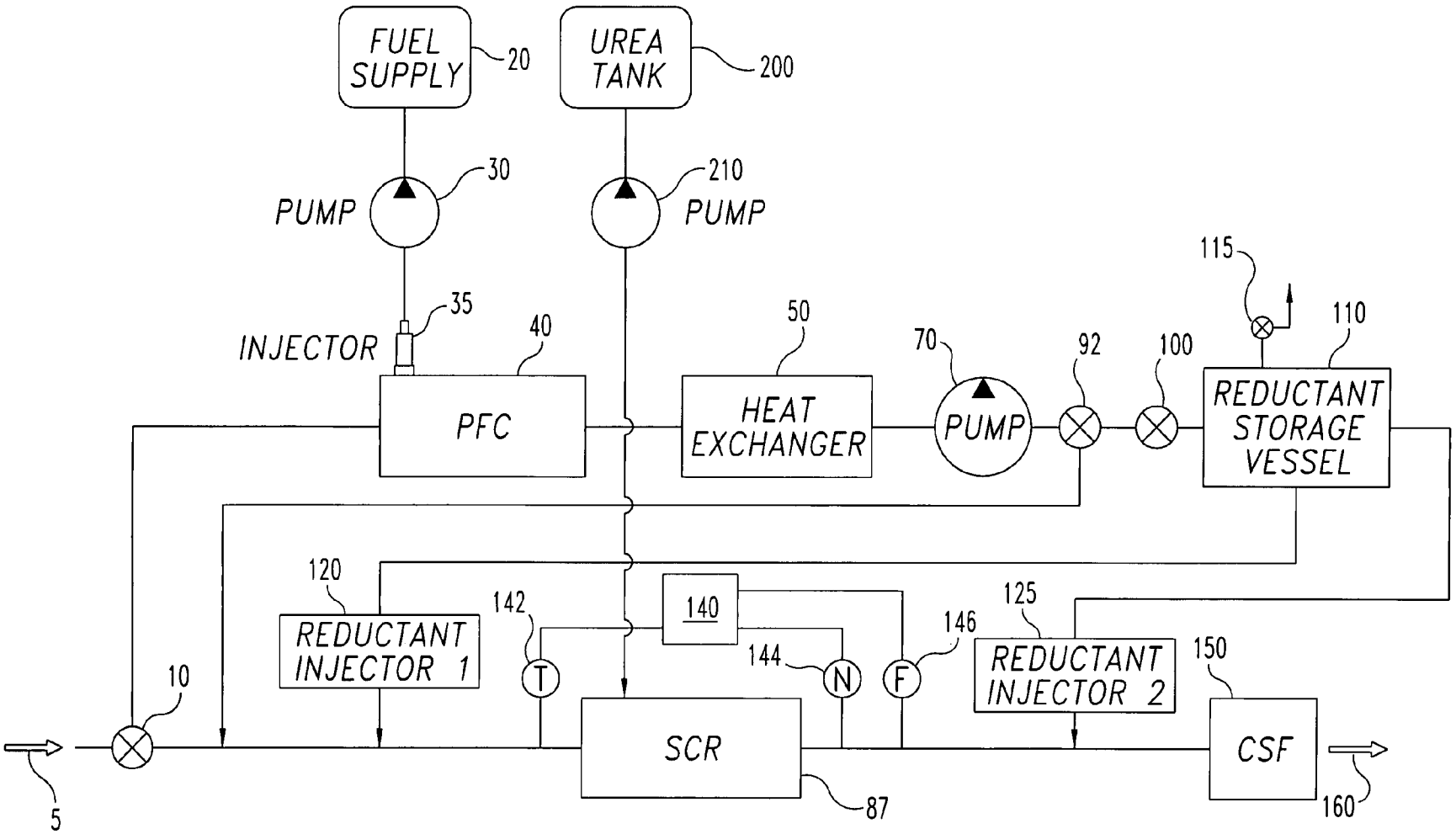
FIG. 6 is a schematic block diagram of a further preferred embodiment of the present invention.

Referring now to FIG. 6, in one embodiment the exhaust aftertreatment system comprises in part a Selective Catalytic Reduction (SCR) system. SCR 87 may be used in place of, or in addition to, a NOx adsorber (see for example FIG. 5) to remove NOxs from engine exhaust.

In one embodiment SCR 87 is provided with a source of urea to reduce NOx to $N_2$. Urea is stored in urea storage tank 200 having a urea storage tank 200 outlet operatively linked to the inlet of urea pump 210. Urea pump 210 has an outlet operatively linked to the urea inlet of SCR 87. As required to reduce NOx to $N_2$ urea from tank 200 is fed into SCR 87 via urea pump 210. In this embodiment it is not necessary to continuously supply SCR 87 with reductants generated by PFC 40. Reductants such as $H_2$ and CO produced by PFC 40 are supplied to SCR 87 only as necessary to regenerate SCR 87, not as a source of reductants for the routine reduction of NOx to $N_2$. This aftertreatment system may be operated under conditions similar to those illustrated in FIG. 5 in connection with an aftertreatment system using an NOx adsorber 80.

If a SCR 87 based aftertreatment system is not supplied with a source of urea 200, the reduction of NOx to $N_2$ catalyzed by the SCR 87 catalyst may require a continuous supply of reductants, such as $H_2$ from PFC 40 for the routine reduction of NOx to $N_2$. When PFC 40 is used to supply reductants to SCR 87 a portion of the exhaust gas 5 generated by the engine may be supplied continuously to PFC 40.

Referring again to FIG. 6, first reductant injector 120 has an inlet operatively linked to the second outlet of reductant storage vessel 110, and a first reductant injector 120 outlet. SCR 87 has an inlet operatively linked to both the second outlet of 3-way exhaust valve 10 and the outlet of first reductant injector 120, and a SCR 87 outlet. Second reductant injector 125 has an inlet operatively connected to the third outlet of vessel 110, and a second injector 125 outlet. CSF 150 has an inlet operatively linked to the outlet of reductant injector 125 and the outlet of SCR 87, and a CSF 150 outlet. Tailpipe 160 has an inlet operatively linked to the outlet of optional CSF 150 or directly to the outlet of SCR 87, and a tailpipe 160 outlet. The outlet of tailpipe 160 is operatively vented to the atmosphere.

Under some conditions it may also be advantageous to regenerate CSF 150 without necessarily having to regenerate SCR 87. In this embodiment an optional second reductant injector 125 is provided having a second reductant injector 125 inlet operatively linked to the third outlet of storage vessel 110 and a second reductant injector 125 outlet. The outlet of second reductant injector 125 is operatively linked to the inlet of CSF 150. The outlet of CSF 150 is operatively linked to the inlet of tailpipe 160. The outlet of tailpipe 160 is operatively vented to the atmosphere.

Under some conditions first reductant injector 120 may be deactivated and second reductant injector 125 may be activated. Under conditions wherein it may be necessary or advantageous to simultaneously regenerate both SCR adsorber 87 and CSF 150 both reductant injectors 120, 125 may be activated. Under conditions when it may be necessary or advantageous to at least partially regenerate SCR 87 before regenerating CSF 150, first injector 120 may be activated while second reductant injector 125 is deactivated.

Figure 7:
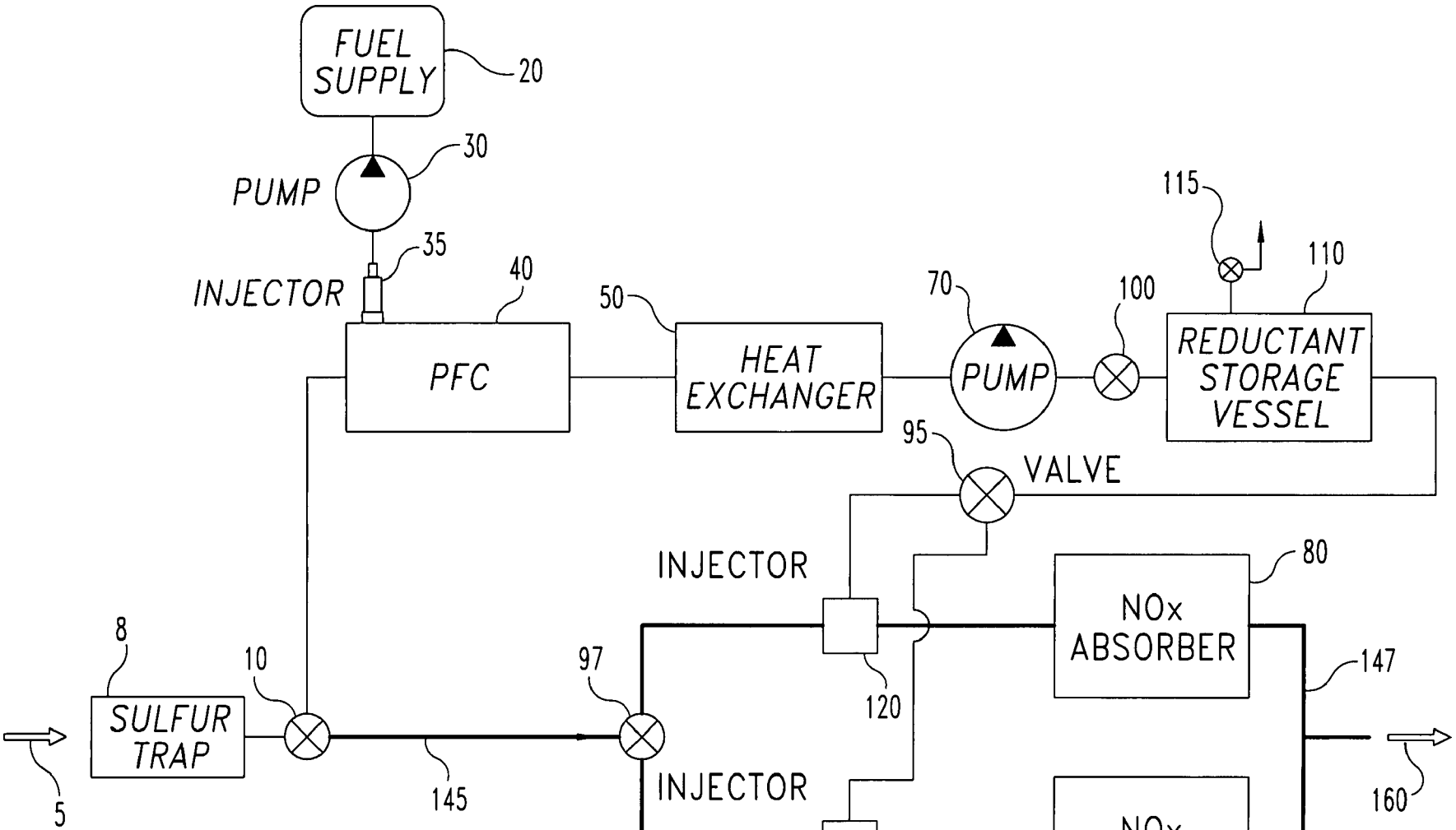
FIG. 7 is a schematic block diagram of another preferred embodiment of the present invention.

Referring now to FIG. 7, in another embodiment, the aftertreatment system includes at least two devices for the removal of NOx from engine exhaust. For example, as illustrated in FIG. 7, the system includes two NOx adsorbers.

The exhaust gas aftertreatment system comprises a sulfur trap 8 having an inlet operatively linked to a source of internal combustion engine exhaust 5, and a sulfur trap 8 outlet. A 3-way exhaust valve 10 is provided having an inlet operatively linked to the outlet of sulfur trap 8, an exhaust valve 10 first outlet, and a first exhaust valve 10 second outlet. A PFC 40 is provided having a PFC inlet operatively linked to the first outlet of first exhaust valve 10, and a PFC 40 outlet. A heat exchanger 50 is provided having an inlet operatively linked to the outlet of PFC 40, and a heat exchanger 50 outlet. A reductant pump 70 is provided having a reductant pump inlet operatively linked to the outlet of heat exchanger 50 and a reductant pump 70 outlet. A check valve 100 is provided having an inlet operatively coupled to the outlet of reductant pump 70, and a check valve 100 outlet. A reductant storage vessel 100 is provided having an inlet operatively linked to the outlet of check valve 100, a storage vessel 110 first outlet, a storage vessel 110 second outlet. An over-pressure release valve 115 is provided having an inlet operatively linked to the second outlet of vessel 110 and a pressure release valve 115 outlet operatively vented to the atmosphere.

Pressure release valve 115 can be adjusted to vent the contents of reductant storage vessel 110 as necessary to maintain the integrity of the system and prevent potentially damaging pressure build-ups. For example, over pressure valve 115 may be designed or adjusted to vent when the pressure within reductant storage vessel 110 reaches, or exceeds 100 p.s.i.

The system further includes a 3-way reductant control valve 95 having a reductant control valve 95 inlet operatively linked to the first outlet of reductant storage vessel 110, a reductant control valve 95 first outlet and a reductant control valve 95 second outlet. A first reductant injector 120 is provided having an inlet operatively coupled to the first outlet of reductant control valve 95, and a first injector 120 outlet. A first NOx adsorber 80 is provided having an inlet operatively linked to the outlet of first injector 120, and a first NOx adsorber outlet. A crossover pipe 147 is provided having a crossover pipe 147 first inlet operatively connected to the outlet of first NOx adsorber 80, a crossover pipe 147 second inlet, and a crossover pipe 147 outlet.

This embodiment further includes a second reductant injector 125 having a second injector inlet operatively linked to the second outlet of reductant valve 95, and a second injector 125 outlet. A second NOx adsorber 85 is provided having an inlet operatively linked to the outlet of second reductant injector 125, and a second NOx adsorber 85 outlet. The second NOx adsorber 85 outlet is operatively linked to the second inlet of crossover pipe 147. Tailpipe 160 is provided having an inlet operatively linked to the outlet of crossover pipe 147, and a tailpipe 160 outlet. The outlet of tailpipe 160 is operatively vented to the atmosphere.

This embodiment further comprises a second exhaust control valve 97 having an inlet operatively linked to the second output of exhaust flow 10, a second exhaust flow valve 97 first outlet, and a second exhaust flow valve 97 second outlet. The first outlet of second exhaust valve 97 is operatively linked to the inlet of first NOx adsorber 80. The second outlet of second exhaust valve 97 is operatively linked to the inlet of second NOx adsorber 85.

One advantage of this embodiment is that the flow of exhaust gas through valve 97 can be shunted to either first NOx adsorber 80 or second NOx adsorber 85. While the flow of exhaust gas to a given NOx adsorber is reduced the flow of reductant to the same NOx adsorber can be increased. The combination of reduced exhaust gas flow and increased reductant flow to a given NOx adsorber results in the delivery of higher effective concentration of reductant to a given NOx adsorber. This enables a given NOx adsorber to be regenerated more efficiently, requiring less time and fewer reductants thereby decreasing the fuel load associated with NOx adsorber regeneration.

While this embodiment was illustrated using two NOx adsorbers 80, 85 it is understood that the invention encompasses the use of additional NOx adsorbers as well. Multiple NOx adsorbers can be used in parallel or series for the removal of NOx from internal combustion engine exhaust.

In another embodiment as illustrated, for example, in FIG. 6 the exhaust aftertreatment system includes a CSF 150. The inlet of CSF 150 is operatively linked to the outlet of crossover pipe 147 (illustrated in FIG. 7).

The scope of this invention also encompasses other exhaust treatment devices as are known in the art, such as, SCR catalysts. This invention can be practiced with a single type of NOx treatment, or storage device, or a plurality of such devices. For example, a single exhaust aftertreatment system can comprise, a NOx adsorber, a SCR catalyst, a CSF, a sulfur trap, a fuel oxidation catalyst, and the like, or a plurality of each component, or any combination thereof.

In one embodiment of the invention, the reductants include 0-30% $H_2$ and 0-30% CO.

In another preferred embodiment of the invention, the reductants include 10-30% $H_2$ and 10-30% CO.

In still another preferred embodiment of the invention, the reductants include 20-30% $H_2$ and 20-30% CO.

In another preferred embodiment of the invention, components of the aftertreatment system are regulated by a closed loop control system. For example as illustrated in FIG. 6, a controller 140 allocates current, fuel, and exhaust flow to PFC 40 and the flow of reductants from pump 70 into NOx adsorbers 80 based on engine run parameters and values listed in a look-up table. In an open loop control system, input from sensors such as 142, 144, 146 are not necessary for the operation of the system.

In one embodiment controller 140 can be an engine controller.

In one embodiment of the invention, controller 140, based on predetermined time settings, engine run parameters, measured levels of NOx or any combination of these criteria, regulates exhaust gas flow through the exhaust system and controls the injection of fuel into the exhaust stream.

The valves used in the practice of the invention including, for example, valves 10, 90, 92, 95, 97, 115 may comprise either variable flow rate control valves or may comprise valves having a fixed number of flow rate settings. For example, referring now to FIG. 1, if the aftertreatment system control scheme dictates that the relative flow of exhaust gas between the PFC and the NOx adsorber will always be 20-80 during regeneration, then exhaust valve 10 may have discrete settings that will allow the engine controller 140 to switch it between reduced flow (20%) and max flow (80%). Optionally, valves 10, 90, 92, 95, 97, 115 may have a variably adjustable flow rate, such that the engine controller 140 can infinitely adjust the flow percentage through each outlet of valve 10 in order to direct the flow of exhaust gas and reductants as desired to regenerate components of the system.

Controller 140 may receive data indicative of engine performance, and exhaust gas composition including, but not limited to, engine sensor data, such as engine position sensor data, speed sensor data, air mass flow sensor data, fuel burn rate data, etc., as is known in the art. The engine controller 140 may further provide data to the engine in order to control the operating state of the engine, and components of the aftertreatment system, as is known in the art.

As detailed hereinabove for a parallel dual adsorber system, the adsorber regeneration cycle switches back and forth between the two sides of the exhaust as necessary in order to keep the outlet exhaust stream purified of excessive emissions. It will be appreciated that since dual exhaust streams are utilized, the system may be operated in full-bypass mode, that is one leg of the system can be used to process the majority of the exhaust while the other leg is undergoing regeneration. One advantage of regenerating a leg of the aftertreatment system in full-bypass mode is that a higher concentration of reductants can be provided to the NOx adsorber (or SCR catalyst) being regenerated.

In one embodiment of the invention, the exhaust aftertreatment system is provided with a carbon soot filter (CSF). CSFs trap diesel soot particulate matter by physical filtering.

A CSF also catalyzes the oxidation of volatile organic compounds in the exhaust such as excess fuel to $CO_2$ and $H_2O$.

Fuel oxidation catalysts can also be used to specifically catalyze the oxidation of volatile hydrocarbons in the engine exhaust. Fuel oxidation catalysts typically include precious metals, which reduce the activation energy of hydrocarbon combustion such that the unburned hydrocarbon is oxidized to carbon dioxide and water. Typically such devices are positioned immediately before the tailpipe assembly, and virtually eliminate the discharge of volatile hydrocarbons from the exhaust aftertreatment system.

While the invention was sometimes illustrated without a sulfur trap (FIGS. 1, 2, 3, 4, 5, and 6), or a CFS (FIG. 7), it should be understood that the invention can be practiced with any combination, arrangement, or absence of, exhaust aftertreatment components, such as NOx adsorbers, sulfur traps, SCR catalysts, CFSs, fuel oxidation catalysts, and the like.

Therefore, the system illustrated and described herein is effective in addressing all legislatively-controlled emissions including NOxs, SOxs and hydrocarbons. NOx adsorbers are used for reduction of NOx levels and are more easily regenerated in this aftertreatment system than in prior art systems due to the presence of plasma fuel converter producing highly reactive reductants and heat for the efficient regeneration NOx adsorbers. Similarly, heat and reductants produced by the PFC in the system can also be used to regenerate SCR catalysts, catalytic soot filters, and the like.

In one preferred embodiment a sulfur trap removes sulfur from the exhaust stream before it is introduced into either the NOx adsorber or the PFC, making the operation of the adsorber more efficient and increasing the work life of the PFC.

In another preferred embodiment a catalytic soot filter traps particulate soot from the exhaust stream.

In still another embodiment a hydrocarbon fuel oxidation catalyst cleans up any leftover hydrocarbons exiting the adsorbers, thereby allowing the exhaust emitted by the system of the present invention to meet or exceed the requirements of the various legislative bodies.

All patents, patent applications, and publications, cited and mentioned in this document are incorporated herein by reference in their entirety.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. And while the invention was illustrated using specific examples, and premised on certain theoretical or idealized accounts of catalysis behavior, these illustrations and the accompanying discussion should by no means be interpreted as limiting the invention.

We claim:

1. A method of treating engine exhaust comprising the steps of: providing an exhaust aftertreatment system comprising:

an engine exhaust outlet;

an exhaust valve system having an exhaust valve inlet an exhaust valve first outlet and an exhaust valve second outlet;

a plasma fuel converter (PFC) having a PFC inlet operatively coupled to the said exhaust valve first outlet, and a PFC outlet;

a NOx adsorber having an adsorber inlet and an NOx adsorber outlet;

a fuel tank having a fuel tank outlet;

a fuel pump having a fuel pump inlet and a fuel pump outlet;

a PFC fuel injector having a PFC injector inlet and a PFC fuel injector outlet;

a reductant pump having a reductant pump inlet and a reductant pump outlet; and a tailpipe having a tailpipe inlet and a tailpipe outlet, wherein said fuel tank outlet is operatively linked to said fuel pump inlet, said fuel pump outlet is operatively linked to said PFC fuel injector input, said PFC fuel injector outlet is operatively linked to said PFC fuel inlet, said exhaust valve system inlet is operatively linked to said engine exhaust outlet, said exhaust valve first outlet is operatively linked to said PFC inlet, said exhaust valve system second outlet is operatively linked to said NOx adsorber input, said PFC outlet is operatively linked to said reductant pump inlet, said reductant pump outlet is operatively linked to said NOx adsorber inlet, said NOx adsorber outlet is operatively linked to said tailpipe inlet and said tailpipe outlet is operatively vented to the atmosphere; and supplying reductants produced by converting fuel in said PFC to said NOx adsorber.

2. The method according to claim 1, wherein said system further includes:

a catalytic soot filter (CSF) having a CSF inlet and a CSF outlet, wherein said CSF inlet is operatively linked to said NOx adsorber outlet and said CSF outlet is operatively linked to said tailpipe inlet.

3. The method according to claim 1, wherein said reductants are supplied to said NOx adsorber inlet continuously.

4. The method according to claim 1, wherein said reductants are supplied to said NOx adsorber inlet intermittently.

5. The method of regenerating a NOx adsorber in accordance with claims 1, 2, 3, or 4 wherein said reductant includes:

20-30% hydrogen ($H_2$); and 20-30% carbon monoxide (CO) and said reductant enriched exhaust is delivered to said NOx adsorber at a rate of 0-200 ml/minute.

6. An internal combustion engine exhaust gas aftertreatment system comprising:

an internal combustion engine exhaust outlet;

an exhaust valve system having an exhaust valve system inlet, an exhaust valve system first outlet and an exhaust valve system second outlet;

a plasma fuel converter (PFC) having a PFC exhaust gas inlet and a PFC exhaust gas outlet;

a NOx adsorber having a NOx adsorber inlet and a NOx adsorber outlet; wherein, said engine exhaust outlet is operatively liked to said exhaust valve system inlet, said exhaust valve system first outlet is operatively linked to said PFC exhaust gas inlet, said exhaust gas valve system second outlet is operatively linked to said NOx adsorber inlet, said PFC outlet is operatively linked to said NOx adsorber inlet, and said NOx adsorber outlet is operatively vented to the atmosphere; and a reductant pump having a reductant pump inlet and a reductant pump outlet wherein said reductant pump inlet is operatively linked to said PFC outlet and said reductant pump outlet is operatively linked to said NOx adsorber inlet.

7. The system of claim 6, wherein said exhaust valve system comprises:

an engine exhaust crossover pipe, having an engine exhaust crossover pipe inlet, an engine exhaust crossover pipe first outlet, and an engine exhaust crossover pipe second outlet;

a first 2-way valve having a first 2-way valve inlet, a first 2-way valve outlet; and a second 2-way valve having a second 2-way valve inlet, and a second 2-way valve outlet, wherein engine exhaust crossover pipe inlet is operatively linked to said internal combustion engine exhaust outlet, said first 2-way valve inlet is operatively linked to said exhaust crossover pipe first outlet, said first 2-way valve outlet is operatively liked to said PFC inlet, said second 2-way valve inlet is operatively linked to said exhaust crossover pipe second outlet, and said second 2-way valve outlet is operatively linked to said NOx adsorber inlet.

8. The exhaust gas aftertreatment system according to claim 6, further comprising:

a fuel tank having a fuel tank outlet;

a fuel pump having a fuel pump inlet and a fuel pump outlet;

a PFC fuel inlet on said PFC; and a fuel injector having a fuel injector inlet and a fuel injector outlet, wherein said fuel pump inlet is operatively linked to said fuel tank outlet, said fuel pump outlet is operatively linked to said fuel injector inlet, and said fuel injector outlet is operatively linked to said PFC fuel inlet.

9. The exhaust gas aftertreatment system of claim 6, further comprising:

a tailpipe having a tailpipe inlet and a tailpipe outlet wherein said tailpipe inlet is operatively linked to said NOx adsorber outlet and said tailpipe outlet is vented to the atmosphere.

10. The exhaust gas aftertreatment system according to claim 6, further comprising:

a sulfur trap having a sulfur trap inlet and a sulfur trap outlet, wherein said sulfur trap inlet is operatively coupled to said internal combustion engine exhaust outlet and said sulfur trap outlet is operatively coupled to said exhaust valve system inlet.

11. The system of claim 6, wherein said exhaust valve system comprises a:

a 3-way valve having a 3-way valve inlet, a 3-way valve first outlet, and a 3-way valve second outlet.

12. The exhaust gas aftertreatment system according to claim 11, further comprising:

a second 3-way exhaust valve having a second 3-way exhaust valve inlet, a second 3-way exhaust valve first outlet, and a second 3-way exhaust valve second outlet; and a second NOx adsorber having a second NOx adsorber inlet, and a second NOx adsorber outlet; and wherein said 3-way exhaust valve second outlet is operatively linked to said second 3-way exhaust valve inlet, said second 3-way exhaust valve first outlet is operatively linked to said NOx adsorber inlet, said second 3-way exhaust valve second outlet is operatively linked to said second NOx adsorber inlet, said PFC outlet is operatively linked to said second NOx adsorber inlet, and said second NOx adsorber outlet is operatively vented to the atmosphere.

13. The exhaust gas aftertreatment system according to claim 6, further comprising:

a catalytic soot filter having a catalytic soot filter inlet and a catalytic soot filter outlet, wherein said catalytic soot filter inlet is operatively coupled to said NOx adsorber output, and said catalytic soot filter outlet is operatively vented to the atmosphere.

14. The exhaust gas aftertreatment system according to claim 13, further comprising:

a 3-way reductant valve having a 3-way reductant valve inlet, a 3-way reductant valve first outlet, and a 3-way reductant valve second outlet, wherein said reductant valve inlet is operatively linked to said PFC outlet, said reductant valve first outlet is operatively linked to said NOx adsorber inlet and said reductant valve second outlet is operatively linked to said catalytic soot filter inlet.

15. The exhaust gas aftertreatment system according to claim 6, further comprising:

a heat exchanger having a heat exchanger inlet, a heat exchanger outlet, wherein said PFC outlet is operatively linked to said heat exchanger inlet and said heat exchanger outlet is operatively linked to said NOx adsorber inlet.

16. The exhaust gas aftertreatment system according to claim 15, further comprising:

a radiator having a radiator coolant inlet and an radiator coolant outlet; wherein said heat exchanger has an heat exchanger coolant inlet and an heat exchanger coolant output, and wherein said radiator coolant outlet is operatively linked to said heat exchanger coolant inlet, and said heat exchanger outlet is operatively linked to said radiator inlet.

17. The exhaust gas aftertreatment system according to claim 16, wherein said radiator is the internal combustion engine radiator.

18. The exhaust gas aftertreatment system according to claim 16, wherein said radiator is an exhaust gas to air radiator.

19. The exhaust gas aftertreatment system according to claim 6, further comprising:

a storage vessel having a storage vessel inlet and a storage vessel outlet, wherein said reductant pump inlet is operatively linked to said PFC outlet, said reductant pump outlet is operatively linked to said storage vessel inlet and said storage vessel outlet is operatively linked to said NOx adsorber inlet.

20. A method of regenerating NOx adsorber in an exhaust aftertreatment system, comprising the steps of:

providing exhaust gas aftertreatment system of claim 19; and regenerating said NOx adsorber by continuously supplying exhaust gas enriched in reductants formed in said PFC to said NOx adsorber inlet.

21. A method of regenerating NOx adsorber in an exhaust aftertreatment system, comprising:

providing the exhaust gas aftertreatment system of claim 19;

regenerating said NOx adsorber by supplying exhaust gas enriched in reductants stored in said storage vessel as required to regenerate said NOx adsorbers.

22. A method of regenerating NOx adsorber in an exhaust aftertreatment system, comprising:

providing the exhaust gas aftertreatment system of claim 19; and regenerating said NOx adsorber by intermittently supplying exhaust gas enriched in reductants formed in said PFC to said NOx adsorber inlet.

23. The method of claim 22 further comprising the steps of:

injecting a sacrificial amount of fuel into said plasma fuel converter continuously; and increasing the level of fuel injected into said PFC intermittently.

24. The exhaust gas aftertreatment system according to claim 19, further comprising:

a storage vessel second outlet; and a storage release valve having a pressure release valve inlet, and a pressure release valve outlet, wherein said storage release valve inlet is operatively linked to said storage vessel second outlet, and said pressure release valve outlet is vented to the atmosphere.

25. The exhaust gas aftertreatment system according to claim 24, wherein said pressure release valve is set to exhaust reductants when said vessel internal pressures exceeds 100 psi.

26. The exhaust gas aftertreatment system according to claim 19, further comprising:

a second storage vessel outlet;

a second NOx adsorber having a second NOx adsorber inlet, and a second NOx adsorber outlet;

a first reductant injector having a first reductant injector inlet and first reductant injector outlet; and a second reductant injector having a second reductant injector inlet and second reductant injector outlet, wherein said storage vessel first outlet is operatively linked to said first reductant injector inlet, said first reductant injector outlet is operatively linked to said NOx adsorber inlet, said second storage vessel outlet is operatively linked to said second reductant injector inlet, said second reductant injector outlet is operatively linked to said second NOx adsorber inlet, and said second NOx adsorber outlet is operatively vented to the atmosphere.

27. The exhaust gas aftertreatment system according to claim 26, further comprising:

a crossover pipe having a crossover pipe first inlet, a crossover pipe second inlet, and a crossover pipe outlet;

a CSF having a CSF inlet and a CSF outlet; and a tailpipe having a tailpipe inlet and a tailpipe outlet, wherein said crossover pipe first inlet is operatively linked to said NOx adsorber outlet, said crossover pipe second inlet is operatively linked to said second NOx adsorber outlet, said crossover pipe outlet is operatively linked to said CSF inlet, said CSF outlet is operatively linked to said tailpipe inlet, and said tailpipe outlet is operatively vented to the atmosphere.

28. The exhaust gas aftertreatment system according to claim 19, further comprising:

a 3-way reductant valve having a 3-way reductant valve inlet, 3-way reductant valve first outlet, and a 3-way reductant valve second outlet;

a second NOx adsorber having a second NOx adsorber inlet and a second NOx adsorber outlet; wherein said 3-way reductant valve inlet is operatively linked to said reductant pump, said 3-way reductant valve first outlet is operatively linked to said first NOx adsorber inlet, said 3-way reductant valve second outlet is operatively linked to said second NOx adsorber inlet, and said second NOx adsorber outlet is operatively linked to the atmosphere.

29. The exhaust gas aftertreatment system according to claim 28, further including:

a crossover pipe having a crossover pipe first inlet, a crossover pipe second inlet, and a crossover pipe outlet; and a CSF having a CSF inlet and a CSF outlet; wherein said first NOx adsorber outlet is operatively linked to said crossover pipe first inlet, said second NOx adsorber outlet is operatively linked to said crossover pipe second inlet, said crossover pipe outlet is operatively linked to said CSF input, said CSF outlet is operatively vented to the atmosphere.

30. The exhaust gas aftertreatment system according to claim 29, further comprising:

a tailpipe having a tailpipe inlet and a tailpipe outlet wherein said tailpipe inlet is operatively linked to said CSF outlet, and said tailpipe outlet is vented to the atmosphere.

31. The exhaust gas aftertreatment system according to claim 30, further comprising:

a NOx sensor having a NOx sensor input and a NOx sensor data output, wherein said NOx sensor input is operatively linked to said exhaust gas valve second output.

32. The exhaust gas aftertreatment system according to claim 31, further comprising:

a controller having a controller sensor data input, and a controller command output, wherein said controller data input is operatively linked to said is operatively linked to said exhaust valve system, said PFC, said reductant pump, and said NOx sensor data output.

33. The exhaust gas aftertreatment system according to claim 32, wherein said exhaust valve system is a proportional 3-way valve.

34. The exhaust gas aftertreatment system according to claim 32, wherein said valve system is a pair of 2-way valves.

35. The exhaust gas aftertreatment system according to claim 32, further comprising:

a sulfur trap having a sulfur trap inlet and a sulfur trap outlet wherein said sulfur trap inlet is operatively coupled to a source of engine exhaust and said sulfur trap outlet is operatively coupled to said exhaust valve inlet.

36. An exhaust gas aftertreatment system according to claim 32, further comprising:

a first NOx sensor having a first NOx sensor input, and a first NOx sensor data output;

a second NOx sensor having a second NOx sensor input and a second NOx sensor data output; and an exhaust gas sensor having an exhaust gas sensor input, an exhaust gas sensor data output, wherein said first NOx sensor input is operatively linked to said 3-way exhaust valve second outlet and said first NOx sensor data output is operatively linked to said controller data input, said second NOx sensor input is operatively linked to said second NOx adsorber outlet, and said exhaust gas sensor data output is operatively linked to controller data input.

37. The exhaust gas aftertreatment system according claim 36, further comprising:

a controller having a controller sensor data inlet and a controller command output, wherein said controller command output is operatively linked to said exhaust valve system, said PFC, said reductant pump, and said controller sensor data input is said first NOx sensor data outlet, said second NOx sensor data outlet, and said exhaust sensor data outlet.

38. The exhaust gas aftertreatment system according to claim 37, further comprising;

a catalytic soot filter having a catalytic soot filter inlet operatively coupled to said first and said second NOx adsorber outputs.

39. The exhaust gas aftertreatment system according to claim 37, further comprising:

a third NOx sensor having a third NOx sensor input, a third NOx sensor data output, wherein said third NOx sensor input is operatively linked to the outlet of said second NOx adsorber outlet.

40. The exhaust gas aftertreatment system according to claim 39, further comprising:

a controller having a controller sensor data input, and a controller command output, wherein said controller command output is operatively linked to said exhaust valve system, said PFC, said reductant pump, and said controller sensor data input is operatively linked to said first NOx sensor data output, said second NOx sensor data output, said third NOx sensor data output and said exhaust sensor data output.

* * * * *